US006130948A

United States Patent [19]

Hirano et al.

[11] Patent Number: 6,130,948

[45] Date of Patent: Oct. 10, 2000

[54] SOUND FIELD PROCESSOR WITH SOUND FIELD EXPANDING APPARATUS

[75] Inventors: Masamitsu Hirano; Noro Masao, both of Shizuoka-ken, Japan

[73] Assignee: Yamaha Corporation, Hamamatsu, Japan

[21] Appl. No.: 08/937,766

[22] Filed: Sep. 25, 1997

[30] Foreign Application Priority Data

Sep. 27, 1996 [JP] Japan ..... 8-256496

[51] Int. Cl.[7] ..... H04R 5/00

[52] U.S. Cl. ..... 381/17; 381/61

[58] Field of Search ..... 381/17, 61, 97, 381/1, 104, 106, 107, 120

[56] References Cited

U.S. PATENT DOCUMENTS 4,833,715 5/1989 Sakai ..... 381/17

*Primary Examiner*—Minsun Oh Harvey

*Attorney, Agent, or Firm*—Pillsbury Madison & Sutro LLP

[57] ABSTRACT

A sound field expanding apparatus is formed from an L-channel sound field expanding circuit and an R-channel sound field expanding circuit that have substantially the same circuit structure. Left and right stereophonic input signals of two channels are input in the L-channel sound field expanding circuit and the R-channel sound field expanding circuit, respectively. The L-channel sound field expanding circuit and the R-channel sound field expanding circuit include a first amplitude/phase characteristic changing circuit and a second amplitude/phase characteristic changing circuit, respectively. The first amplitude/phase characteristic changing circuit and the second amplitude/phase characteristic changing circuit add specified amplitude/phase characteristics to the respective input signals to generate a specified sound field expanding effect. The first and second amplitude/phase characteristic changing circuits are formed on a single IC chip with switched capacitor filters, and have the same structure for both of the first and second amplitude/phase characteristic changing circuits.

13 Claims, 4 Drawing Sheets

SOUND FIELD PROCESSOR WITH SOUND FIELD EXPANDING APPARATUS

BACKGROUND OF THE INVENTION

1. Field of the Invention

The present invention generally relates to a sound field processor, and more particularly, to a sound field expanding apparatus that expands the sound field of a two-channel stereophonic sound and that is readily implemented in LSIs.

2. Description of Related Art

In a conventional two-channel stereophonic apparatus, sound distribution that is generated by right and left speakers of the apparatus is limited within a range between the right loudspeaker and the left loudspeaker. A sound field expanding apparatus is used to expand the sound distribution to areas outside the speakers. In expanding the sound field of a two-channel stereophonic sound, the amplitude characteristic and/or the phase characteristic of a signal in each of the two channels is altered or changed. Then, the two signals are added to each other.

For example, when a specified amplitude-phase characteristic is added to an L-channel sound signal, an inverse characteristic of the specified amplitude-phase characteristic is added to the L-channel sound signal. Then the L-channel sound signal is mixed with an R-channel sound signal. In order to correctly provide the inverse characteristic, a constant of a circuit for changing the amplitude/phase characteristic and a constant of a circuit for changing the inverse characteristic must be set precisely. However, it is very difficult to set precisely such constants in the circuits due to qualitative variations in devices used in the circuits.

To address these problems, the applicant has proposed a sound field expanding apparatus, shown in FIG. 5 (see Japanese patent publication HEI 3-80400). The sound field expanding apparatus is formed from an L-channel sound field expanding circuit A and an R-channel sound field expanding circuit B that have substantially the same structure. An amplitude/phase characteristic changing circuit 37 (37*a*, 37*b*) in each of the circuits A and B changes an amplitude/phase characteristic "X (f) $e^{j}\theta(f)$" of an output signal from an inversion amplifier 36 (where X is an amplitude gain, and θ is a phase variation amount). Then, a signal from the amplitude/phase characteristic changing circuit 37 is outputted to an adder of the opposite channel. More particularly, a signal from the amplitude/phase characteristic changing circuit 37*a* is outputted to an adder 48 of the R-channel sound field expanding circuit B, and a signal from the amplitude/phase characteristic changing circuit 37*b* is outputted to an adder 46 of the L-channel sound field expanding circuit A. Also, the inversion amplifier 36 has a feedback loop that is defined by an output terminal of the inversion amplifier 36→, the amplitude/phase characteristic changing circuit 37→, an adder 44→, an adder 34→, and an inversion input terminal of the inversion amplifier 36. An output signal V2 from the inversion amplifier 36 is represented by the following formula:

$$V2=-V1/\{1+X(f)e^{j}\theta(f)\}$$

When signals L and R are inputted as input signals Ain and Bin to input terminals 33*a* and 33*b*, respectively, the following output signals Aout and Bout are output from output terminals 50 and 52, respectively:

$$Aout=\{L+R\cdot X(f)e^{j}\theta(f)\}/\{1+X(f)e^{j}\theta(f)\}$$

$$Bout=\{R+L\cdot X(f)e^{j\theta}(f)\}/\{1+X(f)e^{j}\theta(f)\}$$

Also, the amplitude/phase characteristic changing circuit 37 is formed from, for example, a secondary low-pass active filter shown in FIG. 6. The secondary low-pass active filter shown in FIG. 6 includes resistors having resistance values R1, R2 and R3, and capacitors having capacity values Cx and Cy. In this case, a cut-off angular frequency W is set to an aural signal band in order to obtain an effect of expanding the sound field, and the cut-off angular frequency W is represented by the following formula:

$$W=1/(R2\cdot R3\cdot Cx\cdot Cy)^{1/2}$$

It is desirable to implement the above-described sound field expanding apparatus in an LSI in order to reduce the number of devices and parts and to improve the reliability of the sound field expanding apparatus. In such a case, as described above, the cut-off angular frequency W of the amplitude/phase characteristic changing circuit 37 is set to the aural signal band. As a result, the resistance value and the capacity value increase substantially. For example, the capacitance value of the capacitors amounts to several hundreds pF to several thousands pF. Accordingly, when a sound field expanding apparatus is implemented in an LSI, the area required for the capacitors on the IC chip becomes substantially large and therefore the cost of the LSI increases.

Also, when different effects in expanding the sound field are desired to be switched, plural resistors and capacitors for the amplitude/phase characteristic changing circuit 37 have to be included in advance. When a user wants to add a specified characteristic to change a given sound field effect, these multiple resistors and capacitors have to be switched in accordance with the specified characteristic that is desired. In this case, more capacitors are required, and implementation of the apparatus in an LSI becomes difficult.

SUMMARY OF THE INVENTION

In order to achieve the above-described objects, a sound field expanding apparatus, in accordance with an embodiment of the present invention, includes first and second adders. Left and right stereophonic input signals of two channels are input to first input terminals of the first and second adders, respectively. Outputs from the first and the second adders are input to inversion input terminals of first and second inversion amplifiers, respectively. A first amplitude/phase characteristic changing circuit is connected between an output terminal of the first inversion amplifier and a second input terminal of the first adder. The first amplitude/phase characteristic changing circuit adds a specified amplitude/phase characteristic to a signal output from the first inversion amplifier. A second amplitude/phase characteristic changing circuit is connected between an output terminal of the second inversion amplifier and a second input terminal of the second adder. The second amplitude/phase characteristic changing circuit adds a specified amplitude/phase characteristic to a signal output from the second inversion amplifier. A third adder adds an output signal from the first inversion amplifier and an output signal from the second amplitude/phase characteristic changing circuit. A fourth adder adds an output signal from the second inversion amplifier and an output signal from the first amplitude/phase characteristic changing circuit. In a preferred embodiment of the present invention, the first and second amplitude/phase characteristic changing circuits are formed on a single IC chip from switched capacitor filters. Preferably, the first and second amplitude/phase characteristic changing circuits have the same structure.

In accordance with still another embodiment of the present invention, at least one of the first capacitor, the second capacitor, the first switched capacitor, the second switched capacitor, the third switched capacitor and the fourth switched capacitor is formed from a plurality of capacitors and a plurality of switches. The switches are controlled to select and combine or change a plurality of the capacitors to match with a given expanded sound field.

Other features and advantages of the invention will be apparent from the following detailed description, taken in conjunction with the accompanying drawings which illustrate, by way of example, various features of embodiments of the invention.

BRIEF DESCRIPTION OF THE DRAWINGS

A detailed description of embodiments of the invention will be made with reference to the accompanying drawings

DETAILED DESCRIPTION OF PREFERRED EMBODIMENTS

Figure 1:
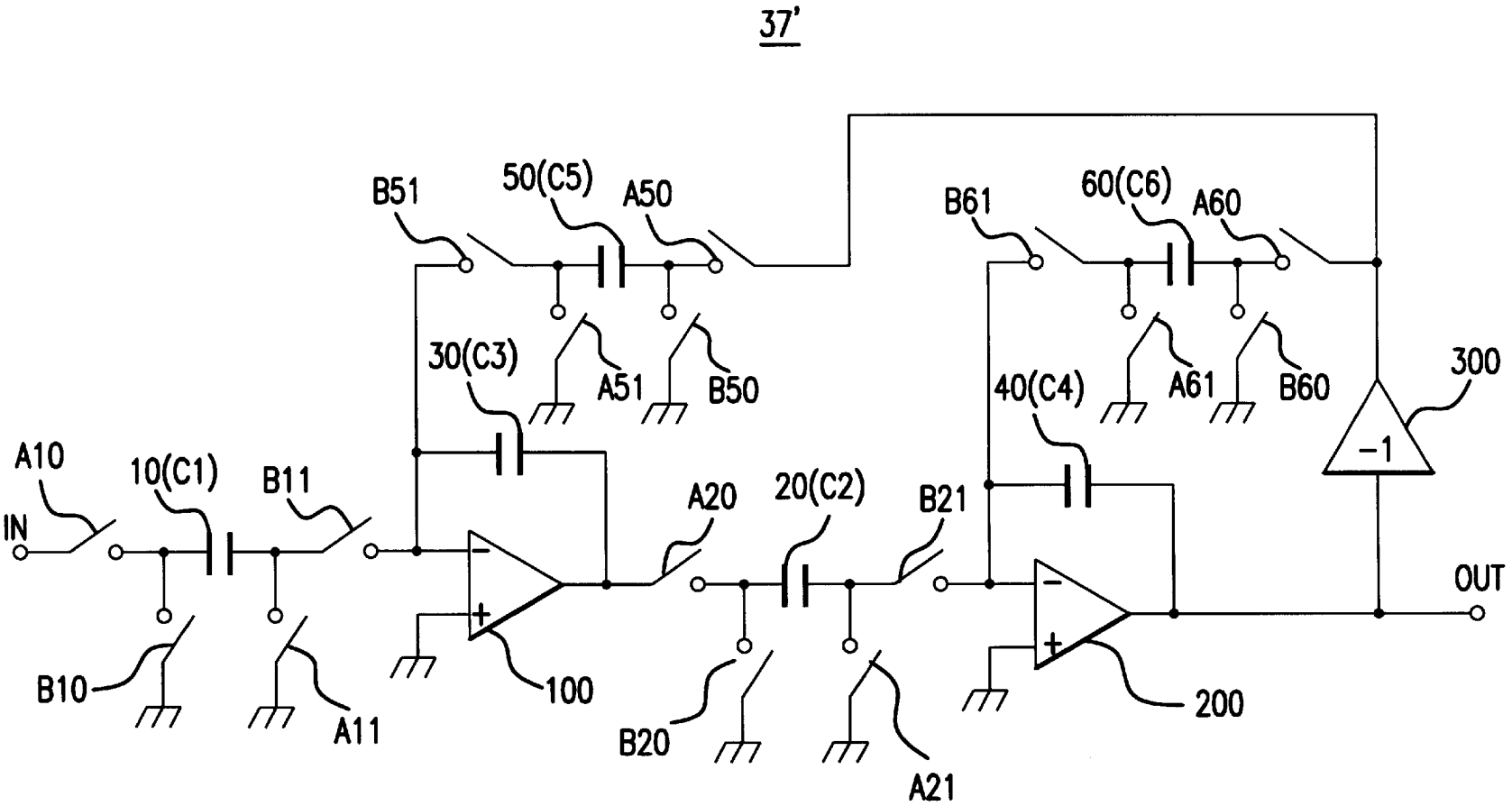
FIG. 1 shows a circuit diagram of an amplitude/phase characteristic changing circuit that is used for a sound field expanding apparatus in accordance with an embodiment of the present invention.

A sound field expanding apparatus in accordance with an embodiment of the present invention has substantially the same structure of a conventional sound field expanding apparatus except for the addition of a novel amplitude/phase characteristic changing circuit 37'. Therefore, only the amplitude/phase characteristic changing circuit 37' will be described with reference to the accompanying drawings. FIG. 1 shows a circuit diagram of the amplitude/phase characteristic changing circuit 37' for a sound field expansion apparatus in accordance with an embodiment of the present invention. In accordance with an embodiment of the present invention, two amplitude/phase characteristic changing circuits 37' having the same circuit structure are used in the L-channel sound field expanding circuit A and an R-channel sound field expanding circuit B, respectively.

Figure 2:
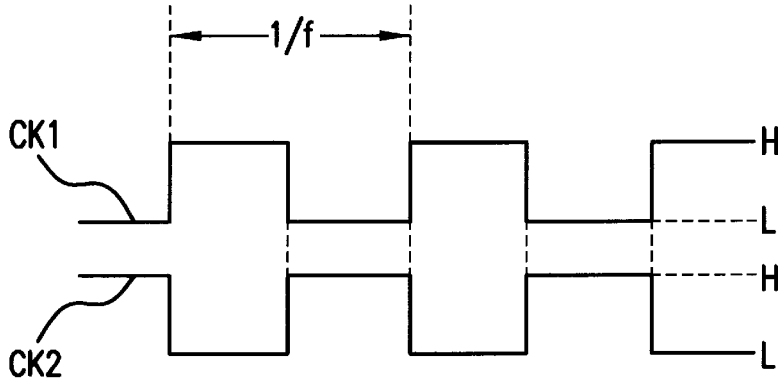
FIG. 2 shows wave-shapes of a first clock and a second clock in accordance with an embodiment of the present invention.

As shown in FIG. 1, the amplitude/phase characteristic changing circuit 37' includes inversion amplifiers 100 and 200, an inversion type buffer amplifier 300, and capacitors 10, 20, 30, 40, 50 and 60. Capacitance of each of the capacitors 10, 20, 30, 40, 50 and 60 is C1, C2, C3, C4, C5 and C6, respectively. A first switch group SWa includes switches A10, A11, A20, A21, A50, A51, A60 and A61, and is controlled by a first clock CK1. A second switch group SWb includes switches B10, B11, B20, B21, B50, B51, B60 and B61, and is controlled by a second clock CK2. The switches in the first and the second switch groups SWa and SWb are connected to both terminals of each of the capacitors 10, 20, 50 and 60. More specifically, the amplitude/phase characteristic changing circuit 37' includes the inversion operation amplifiers 100 and 200 having normal input terminals that are grounded. A first switched capacitor (including the switches A10, A11, B10, B11 and the capacitor 10) is connected between the input terminal and an inversion input terminal of the inversion operation amplifier 100. The capacitor 30 is connected between an output terminal and the inversion input terminal of the inversion operation amplifier 100. A second switched capacitor (including the switches A20, A21, B20, B21 and the capacitor 20) is connected between the output terminal of the inversion operation amplifier 100 and an inversion input terminal of the inversion operation amplifier 200. The capacitor 40 is connected between an output terminal and the inversion input terminal of the inversion operation amplifier 200. A buffer amplifier 300 inverses an output signal that is output from the inversion operation amplifier 200. A third switched capacitor (including the switches A50, A51, B50, B51 and the capacitor 50) is connected between an output terminal of the buffer amplifier 300 and the inversion input terminal of the inversion operation amplifier 100. A fourth switched capacitor (including the switches A60, A61, B60, B61 and the capacitor 60) is connected between the output terminal of the buffer amplifier 300 and the inversion input terminal of the inversion operation amplifier 200. The first clock CK1 and the second clock CK2 have phases shifted from each other by 180 degrees, as shown in FIG. 2, and each of the clocks has a frequency of f Hz. The switches in the first switch group SWa and the second switch group SWb turn on when the first clock CK1 and the second clock CK2 are at a high level (H), and turn off when these clocks CK1 and CK2 are at a low level (L).

In the present embodiment, the capacitors 10, 20, 50 and 60 and the switches in the first and the second switch groups SWa and SWb form switched capacitors. Accordingly, the capacitors 10, 20, 50 and 60 equivalently function as resistors, and have equivalent resistances of 1/(f·C1), 1/(f·C2), 1/(f·C5) and 1/(f·C6), respectively.

Figure 3:
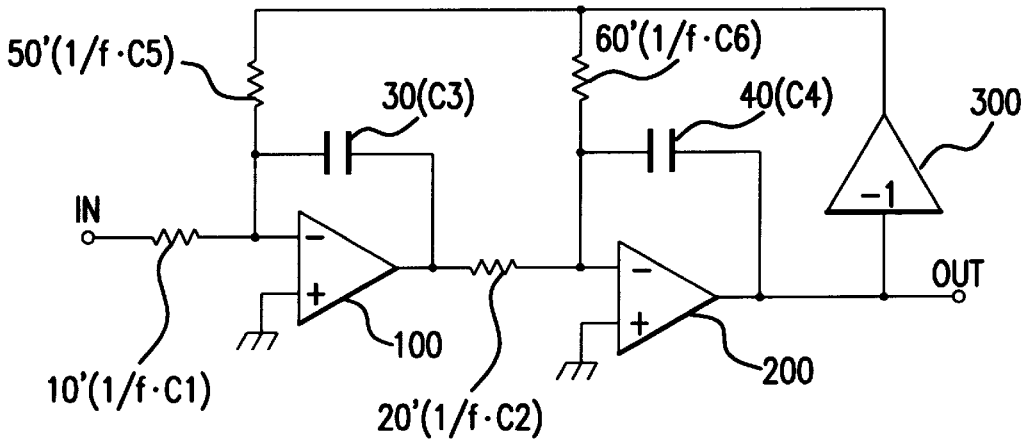
FIG. 3 shows a circuit diagram of an equivalent circuit of the amplitude/phase characteristic changing circuit shown in FIG. 1.

As a result, the amplitude/phase characteristic changing circuit 37' shown in FIG. 1 is equivalent to the circuit shown in FIG. 3. In this circuit, voltage gain Av, cut-off frequency Fc and Q value are given by the following formulae:

$$Av=C1/C5 \quad (1)$$

$$fc=(f/2\pi)\cdot\{(C2\cdot C5)/(C3\cdot C4)\}^{1/2} \quad (2)$$

$$Q=\{(C2\cdot C4\cdot C5)/(C6^2\cdot C3)\}^{1/2} \quad (3)$$

As is clear from formula 1, the voltage gain Av is determined by the ratio between C1 and C5. The cut-off frequency fc is determined by the ratio between "C2·C5" and "C3·C4" and the clock frequency f. In this case, the clock frequency f is set at a value that lowers the capacitance values C2, C3, C4 and C5 and allows the capacitors to be implemented in an IC chip. The Q value is determined by the ratios of "C2·C4·C5" and "$C6^2$·C3".

Therefore, when device-to-device relative accuracy among the capacitors 10 through 60 shown in FIG. 1 is secured, a specified amplitude/phase characteristic is achieved. This substantially eliminates the requirement of absolute accuracy of each individual device. It is noted that the capacitors on the IC chip are provided in the form of junction capacitors in the case of the bipolar process and in the form of MOS capacitors in the case of the MOS process. In both of the processes, the capacitance value is proportional to the electrode area, and the electrode area is determined by the mask area used during manufacture of the IC. Accordingly, capacitors can be formed on an IC chip with relatively high accuracy. Therefore, the amplitude/phase characteristic changing circuit 37' having the above-described structure achieves a highly accurate amplitude/phase characteristic. In this embodiment, the amplitude/phase characteristic changing circuits 37*a* and 37*b* are provided in the L-channel sound field expanding apparatus A and the R-channel sound field expanding apparatus B, respectively, and the amplitude/phase characteristic changing circuits 37*a* and 37*b* should preferably have the same characteristics. In accordance with the embodiment of the present invention, since the two amplitude/phase characteristic changing circuits 37' for the L-channel sound field expanding apparatus A and the R-channel sound field expanding apparatus B are formed on a single IC chip, the amplitude/phase characteristics of the two amplitude/phase characteristic changing circuits 37' are determined by relative capacitance values of the capacitors which form the circuits 37'. As a result, the amplitude/phase characteristics of the two circuits 37' for the L-channel sound field expanding apparatus A and the R-channel sound field expanding apparatus B are matched with one another with substantially high accuracy.

In a preferred embodiment, the capacitance value of each of the capacitors 10 through 60 shown in FIG. 1 is variable.

Figure 4:
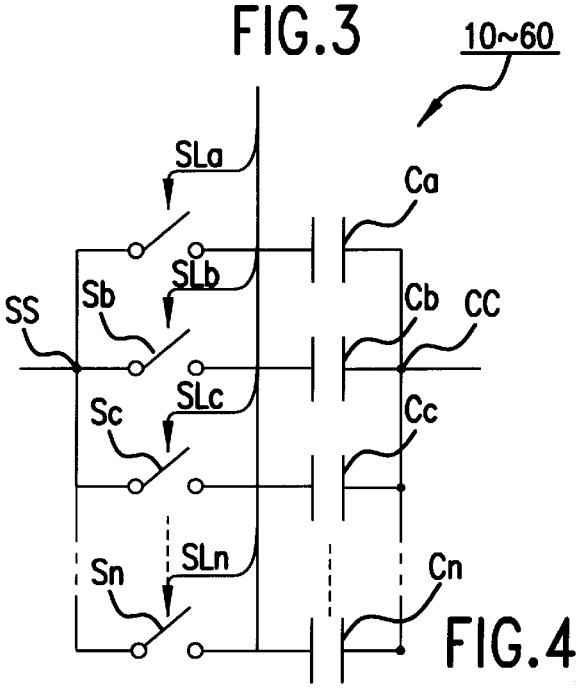
FIG. 4 shows a circuit diagram of each capacitor in the amplitude/phase characteristic changing circuit shown in FIG. 1 in accordance with an embodiment of the present invention.
Figure 5:
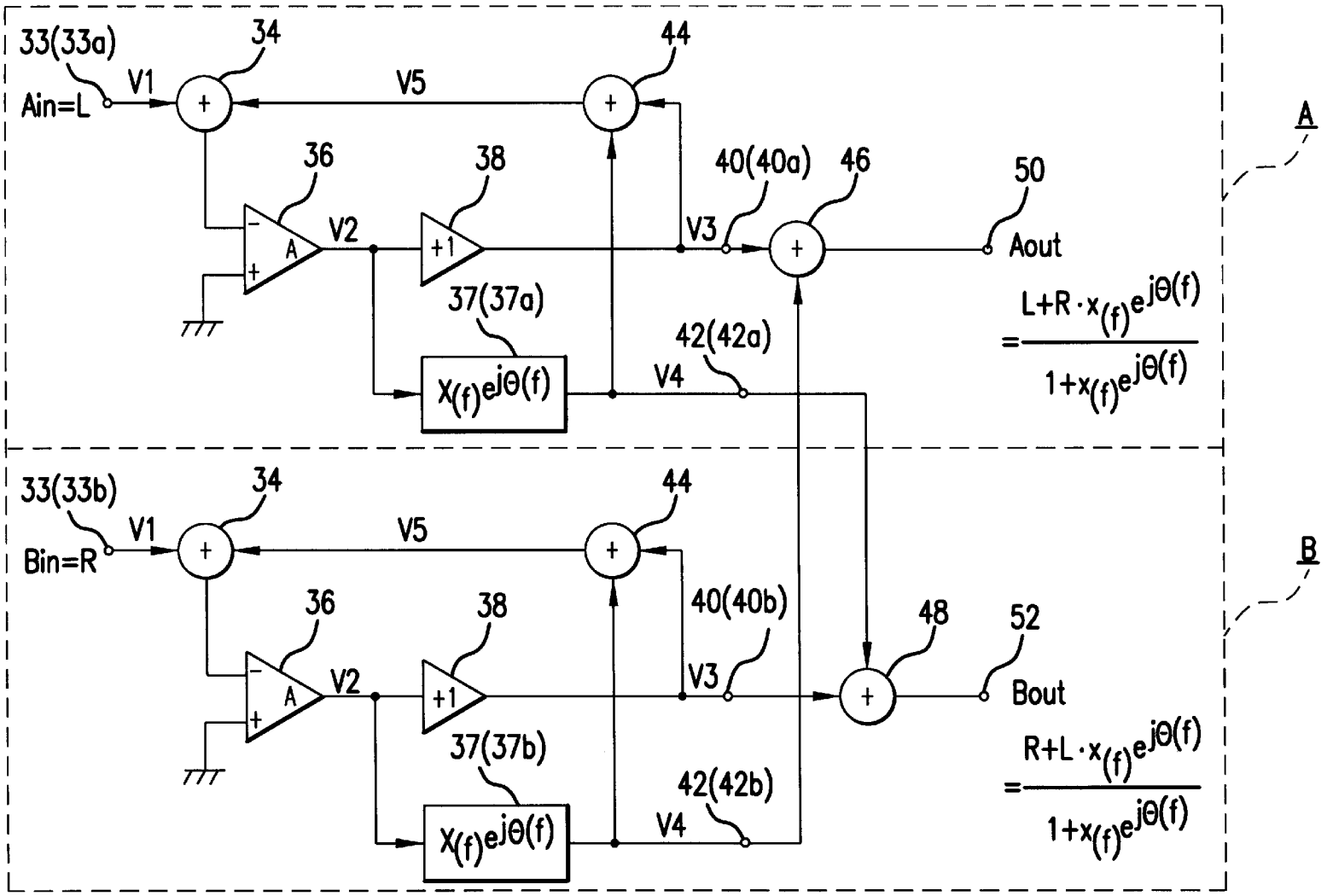
FIG. 5 (PRIOR ART)
FIG. 5 shows a circuit diagram of a conventional sound field expanding apparatus.
Figure 6:
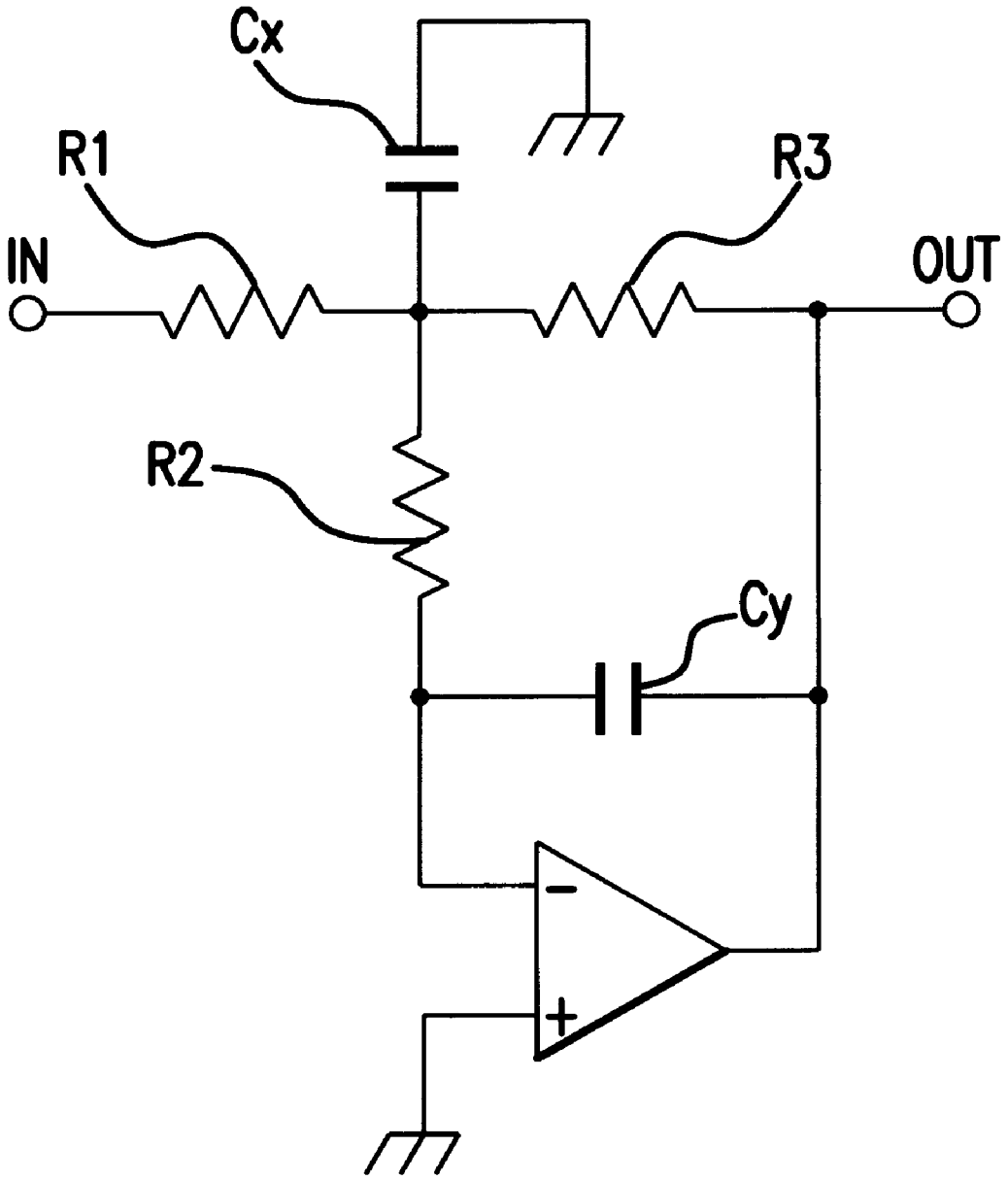
FIG. 6 (PRIOR ART)
FIG. 6 shows a circuit diagram of an amplitude/phase characteristic changing circuit used for a conventional sound field expanding apparatus.

Referring to FIG. 4, a circuit that changes amplitude/phase characteristics will be described. FIG. 4 shows a circuit diagram of a structure of each of the capacitors 10 through 60 shown in FIG. 1. FIG. 4 shows capacitors Ca, Cb, Cc, . . . , and switches Sa, Sb, Sc, . . . which are independently controlled by selection signals SLa, SLb, SLc, . . . , respectively. FIG. 4 shows only three capacitors Ca, Cb and Cc, and three switches Sa, Sb, and Sc, for simplicity. However, it is noted that each of the capacitors 10 through 60 may have more than three capacitors and more than three switches. One end of the capacitors Ca, Cb, Cc, . . . is connected at a connection point CC. The other end of the capacitors Ca, Cb, Cc, . . . is connected through the switches Sa, Sb, Sc, . . . at a connection point SS. The capacitance value of the capacitors Ca, Cb, Cc, . . . is selected by optionally selecting and combining appropriate ones of the capacitors, or by switching the capacitors in synchronism with the switching frequency f to provide a variety of different sound field expansion effects. In other words, when the selection signals SLa, SLb, SLc, . . . are input in the switches Sa, Sb, Sc, . . . , specified ones of the capacitors are selected or combined. As a result, a variety of different sound field expansion effects are achieved.

Now, let us consider the above-described formulae 1 through 3. It is noted that the capacity value C1 appears only in the formula 1, that determines the voltage gain Av, and the capacitance value C6 appears only in formula 3, that determines the Q value. Therefore, when the cut-off frequency fc and the Q value are maintained at constant, and only the voltage gain Av is changed, only the capacitance value of the capacitor 10 shown in FIG. 1 is changed. When the voltage gain Av and the cut-off frequency fc are maintained at constant, and only the Q value is changed, only the capacitance value of the capacitor 60 is changed. When the cut-off frequency fc is changed, the clock frequency f is changed, or the capacitors 20, 30, 40 and 50 are appropriately switched with one another.

As described above, in accordance with the embodiments of the present invention, an amplitude/phase characteristic changing circuit 37' is formed from switched capacitor filters (SCF). As a result, a sound field expanding apparatus is implemented in an IC, and therefore the number of devices required for the apparatus is reduced and the reliability of a sound field expanding apparatus is improved.

Also, in accordance with the embodiments of the present invention, the amplitude/phase characteristic of the sound field expanding apparatus depends on relative capacitance values of the capacitors that form the amplitude/phase characteristic changing circuit 37' and the clock frequency f. As a result, the overall accuracy of the amplitude/phase characteristic is improved. Also, the difference in the characteristics between the L-channel and the R-channel is substantially eliminated. As a consequence, a more natural sound field expansion effect is created.

Further, the capacitance values C1 through C6 of the capacitors 10 through 60 are selectively changed to provide a variety of different amplitude characteristics and phase characteristics. As a result, a sound field expanding apparatus can select an appropriate sound field expansion effect depending upon the particular type of music, such as, classical, pop, and the like, or the particular place where a piece of music is played, such as, inside a room, inside a car, or the like.

The present invention is not limited to the above-described embodiments, and a variety of modifications including those described below are possible.

For example, in the above-described embodiment, each of the capacitors 10 through 60 is formed from the capacitors Ca, Cb, Cc, . . . and Cn and the switches Sa, Sb, Sc, . . . and Sn, as shown in FIG. 4. However, all of the capacitance values of the capacitors 10 through 60 do not have to be changed. In other words, capacitance values of only specified ones of the capacitors, that achieve a desired amplitude/phase characteristic, may be changed.

In the above-described embodiment, the clock frequency f and capacitance values of the capacitors Ca, Cb, Cc, . . . and Cn may be selectively and appropriately changed and combined to change the cut-off frequency fc. Also, different clocks may be supplied to the respective switches that form switched capacitors. For example, when a clock signal having a frequency of fck1 is supplied to the switches A10, A11, B10 and B11, and the switches A50, A51, B50 and B51, a voltage gain Av is obtained. However, when the frequency of the clock signal that is supplied to the switches A10, A11, B10 and B11 is changed to 2·fck1, the voltage gain Av is doubled.

As described above, in accordance with the characteristics of the present invention, sound field expanding apparatuses are readily implemented in LSIs, and the amplitude/phase characteristics of the apparatuses can be readily changed. Moreover, a desired amplitude/phase characteristic is accurately added. As a result, amplitude/phase characteristics that are changed in right and left channels accurately match one another, and therefore a good level balance is normally maintained between the right and left channels. As a consequence, a sound field that provides a more natural sound expansion is created.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A sound field expanding apparatus comprising:

first and second adders that respectively receive left and right stereophonic input signals of two channels;

first and second inversion amplifiers coupled to the first and second adders, respectively, the first and second inversion amplifiers having inversion input terminals that receive signal outputs from the first and second adders, respectively;

a first amplitude/phase characteristic changing circuit connected between the first inversion amplifier and the first adder, the first amplitude/phase characteristic changing circuit for adding a first specified amplitude/phase characteristic to a signal output from the first inversion amplifier;

a second amplifier/phase characteristic changing circuit connected between the second inversion amplifier and the second adder, the second amplitude/phase characteristic changing circuit for adding a second specified amplitude/phase characteristic to a signal output from the second inversion amplifier;

a third adder that adds an output signal from the first inversion amplifier and an output signal from the second amplitude/phase characteristic changing circuit; and a fourth adder that adds an output signal from the second inversion amplifier and an output signal from the first amplitude/phase characteristic changing circuit; wherein the first and second amplitude/phase characteristic changing circuits are formed on a single IC chip, each of the first and second amplitude/phase characteristic changing circuits being formed from a plurality of switched capacitor filters, wherein each of the first and second amplitude/phase characteristic changing circuits includes, an input terminal, first and second inversion operation amplifiers, each of the first and second inversion operation amplifier having a normal input terminal being grounded, an inversion input terminal, and an output terminal, a first switched capacitor connected between the input terminal and the inversion input terminal of the first inversion operation amplifier, a first capacitor connected between the output terminal and the inversion input terminal of the first inversion operation amplifier, a second switched capacitor connected between the output terminal of the first inversion operation amplifier and the inversion input terminal of the second inversion operation amplifier, a second capacitor connected between the output terminal and the inversion input terminal of the second inversion operation amplifier, a buffer amplifier having an input terminal and an output terminal, the input terminal of the buffer amplifier being connected to the output terminal of the second inversion operation amplifier for inversing an output signal from the second inversion operation amplifier, a third switched capacitor connected between the output terminal of the buffer amplifier and the inverse input terminal of the first inversion operation amplifier, and a fourth switched capacitor connected between the output terminal of the buffer amplifier and the inverse input terminal of the second inversion operation amplifier.

2. A sound field expanding apparatus according to claim 1, wherein at least one of the first capacitor, the second capacitor, the first switched capacitor, the second switched capacitor, the third switched capacitor and the fourth switched capacitor includes a plurality of capacitors and a plurality of switches, and further comprising a controller that selects and combines plural ones of the plurality of switches to provide a specified sound field expanding effect.

3. A sound field expanding apparatus comprising:

first and second adders that respectively receive left and right stereophonic input signals of two channels;

first and second inversion amplifiers coupled to the first and second adders, respectively, the first and second inversion amplifiers having inversion input terminals that receive signal outputs from the first and second adders, respectively;

a first amplitude/phase characteristic changing circuit connected between the first inversion amplifier and the first adder, the first amplitude/phase characteristic changing circuit for adding a first specified amplitude/phase characteristic to a signal output from the first inversion amplifier;

a second amplitude/phase characteristic changing circuit connected between the second inversion amplifier and the second adder, the second amplitude/phase characteristic changing circuit for adding a second specified amplitude/phase characteristic to a signal output from the second inversion amplifier;

a third adder that adds an output signal from the first inversion amplifier and an output signal from the second amplitude/phase characteristic changing circuit; and a fourth adder that adds an output signal from the second inversion amplifier and an output signal from the first amplitude/phase characteristic changing circuit, wherein each of the first and second amplitude/phase characteristic changing circuits includes:

an input terminal;

first and second inversion operation amplifiers, each of the first and second inversion operation amplifiers having a normal input terminal being grounded, an inversion input terminal, and an output terminal;

a first switched capacitor connected between the input terminal and the inversion input terminal of the first inversion operation amplifier;

a first capacitor connected between the output terminal and the inversion input terminal of the first inversion operation amplifier;

a second switched capacitor connected between the output terminal of the first inversion operation amplifier and the inversion input terminal of the second inversion input terminal of the second inversion operation amplifier;

a second capacitor connected between the output terminal and the inversion input terminal of the second inversion operation amplifier;

a buffer amplifier having an input terminal and an output terminal, the input terminal of the buffer amplifier being connected to the output terminal of the second inversion operation amplifier for inversing an output signal from the second inversion operation amplifier;

a third switched capacitor connected between the output terminal of the buffer amplifier and the inversion input terminal of the first inversion operation amplifier; and a fourth switched capacitor connected between the output terminal of the buffer amplifier and the inversion input terminal of the second inversion operation amplifier.

4. A sound field expanding apparatus according to claim 3, wherein at least one of the first capacitor, the second capacitor, the first switched capacitor, the second switched capacitor, the third switched capacitor and the fourth switched capacitor includes a plurality of capacitors and a plurality of switches, and further comprising a controller that selects and combines plural ones of the plurality of switches to provide a specified sound field expanding effect.

5. A sound field expanding apparatus according to claim 3, wherein at least one of the first capacitor, the second capacitor, the first switched capacitor, the second switched capacitor, the third switched capacitor and the fourth switched capacitor is provided in the form of a junction capacitor of a bipolar process.

6. A sound field expanding apparatus according to claim 3, wherein at least one of the first capacitor, the second capacitor, the first switched capacitor, the second switched capacitor, the third switched capacitor and the fourth switched capacitor is provided in the form of a MOS capacitor of a MOS process.

7. A sound field expanding apparatus according to claim 3, wherein each of the first and second amplitude/phase characteristic changing circuits have the same structure.

8. A sound field expanding apparatus comprising a first amplitude/phase characteristic changing circuit for adding a specified amplitude/phase characteristic to a first input signal of a two-channel stereophonic signal and a second amplitude/phase characteristic changing circuit for adding a specified amplitude/phase characteristic to a second input signal of the two-channel stereophonic signal, the improvement wherein the first and second amplitude/phase characteristic changing circuits, are formed on a single IC chip, each of the first and second amplitude/phase characteristic changing circuits being formed from a plurality of switched capacitor filters, wherein each of the first and second amplitude/phase characteristic changing circuits includes, first and second inversion operation amplifiers, each of the first and second inversion operation amplifier having a normal input terminal being grounded, an inversion input terminal, and an output terminal, a first switched capacitor connected between the normal input terminal and the inversion input terminal of the first inversion operation amplifier, a first capacitor connected between the output terminal and the inversion input terminal of the first inversion operation amplifier, a second switched capacitor connected between the output terminal of the first inversion operation amplifier and the inversion input terminal of the second inversion operation amplifier, a second capacitor connected between the output terminal and the inversion input terminal of the second inversion operation amplifier, a buffer amplifier having an input terminal and an output terminal, the input terminal of the buffer amplifier being connected to the output terminal of the second inversion operation amplifier for inversing an output signal from the second inversion operation amplifier, a third switched capacitor connected between the output terminal of the buffer amplifier and the inverse input terminal of the first inversion operation amplifier, and a fourth switched capacitor connected between the output terminal of the buffer amplifier and the inverse input terminal of the second inversion operation amplifier.

9. A sound field expanding apparatus comprising:

a first amplitude/phase characteristic changing circuit for adding a first amplitude/phase characteristic to a first input signal; and a second amplitude/phase characteristic changing circuit for adding a second amplitude/phase characteristic to a second input signal, wherein each of the first and second amplitude/phase characteristic changing circuits utilizes a switched capacitor to function as a resistor used to control at least one of voltage gain, cut-off frequency and Q value of the corresponding amplitude/phase characteristic changing circuit.

10. A sound field expanding apparatus according to claim 9, wherein the first and second amplitude/phase characteristic changing circuits are formed on a single IC chip.

11. A sound field expanding apparatus according to claim 9, wherein the first and second amplitude/phase characteristic changing circuits have the same structure.

12. A sound field expanding apparatus according to claim 9, wherein the switched capacitor in each of the first and second amplitude/phase characteristic changing circuits includes a plurality of switches and a junction capacitor of a bipolar process.

13. A sound field expanding apparatus according to claim 9, wherein the switched capacitor in each of the firsts and second amplitude/phase characteristic changing circuits includes a plurality of switches and a MOS capacitor of a MOS process.

* * * * *